US005926078A

United States Patent [19]

Hino et al.

[11] Patent Number: 5,926,078

[45] Date of Patent: Jul. 20, 1999

[54] DIELECTRIC FILTER INCLUDING VARIOUS MEANS OF ADJUSTING THE COUPLING BETWEEN RESONATORS

[75] Inventors: Seigo Hino; Shoji Ono; Masaki Shibata, all of Nagoya, Japan

[73] Assignee: NGK Spark Plug Co., Ltd., Nagoya, Japan

[21] Appl. No.: 08/688,103

[22] Filed: Jul. 29, 1996

[30] Foreign Application Priority Data

Aug. 4, 1995 [JP] Japan ..... 7-219548
Mar. 29, 1996 [JP] Japan ..... 8-103618

[51] Int. Cl.[6] ..... H01P 1/201

[52] U.S. Cl. ..... 333/202; 333/206

[58] Field of Search ..... 333/203, 206, 333/202, FOR 202 DB

[56] References Cited

U.S. PATENT DOCUMENTS

| | | | |
|---|---|---|---|
| 4,768,003 | 8/1988 | Kawakami et al. | 333/202 |
| 4,799,033 | 1/1989 | Igarashi et al. | 333/202 X |
| 4,806,889 | 2/1989 | Nakano et al. | 333/206 X |
| 4,891,615 | 1/1990 | Komozaki et al. | 333/206 |
| 5,150,089 | 9/1992 | Komozaki et al. | 333/206 |
| 5,541,560 | 7/1996 | Turunen et al. | 333/207 |

FOREIGN PATENT DOCUMENTS

| | | | |
|---|---|---|---|
| 0364831 | 4/1989 | European Pat. Off. . | |
| 0322780 | 7/1989 | European Pat. Off. . | |
| 0 614 244 A1 | 9/1994 | European Pat. Off. . | |
| 07086806 | 3/1995 | European Pat. Off. . | |
| 3-69202 | 7/1984 | Japan . | |
| 189001 | 2/1985 | Japan | 333/202 DB |
| 18801 | 1/1987 | Japan | 333/202 DB |
| 801 | 1/1989 | Japan | 333/202 DB |
| 53601 | 3/1989 | Japan | 333/202 DB |
| 72701 | 3/1990 | Japan | 333/202 DB |
| 51-83309 | 7/1993 | Japan | 333/202 DB |
| H07-66608 | 3/1995 | Japan . | |

*Primary Examiner*—Benny Lee
*Attorney, Agent, or Firm*—Larson & Taylor

[57] ABSTRACT

A dielectric filter is adapted to show a specified coupling capacitance without inadvertently affecting the resonance frequency, in which a dielectric ceramic block is provided with two or more than two resonant conductors arranged in parallel, a conductive circuit film is formed on the open-circuit end surface of said dielectric ceramic block and electrically separated from the inner conductive films of the resonant conductors by arranging insulation gaps therebetween to capacitively couple the conductive circuit film and the resonant conductors by way of the insulation gap.

3 Claims, 11 Drawing Sheets

DIELECTRIC FILTER INCLUDING VARIOUS MEANS OF ADJUSTING THE COUPLING BETWEEN RESONATORS

BACKGROUND OF THE INVENTION

The present invention relates to a dielectric filter having a plurality of resonant conductors arranged in parallel relative to each other, and a method of adjusting a coupling capacitance of such a dielectric filter.

There is known a dielectric filter comprising a dielectric block and two or more resonant conductors arranged in parallel with each other in the dielectric block and formed by coating the inner surface of respective through bores of the dielectric block with an inner conductive film, the outer surfaces of the dielectric block being coated by an outer conductive film except one of the end surfaces carrying the openings of said through bores, making the end surface open circuited.

Japanese Patent Publication No. 3-69202 discloses a dielectric filter having a configuration as illustrated in FIG. 1 of the accompanying drawings. Referring now to FIG. 1, a conductor film P for a capacitive coupling circuit having a certain pattern is provided on an open-circuit end surface of a dielectric block A carrying no outer conductive film. The conductor film P of the capacitive coupling circuit includes two patterned conductors D which are connected to respective inner conductive films of resonant conductors B and separated by a gap S to provide a capacitive coupling. With this arrangement, the resonant conductors B are connected with each other by way of a coupling capacitance for an interstage connection in order to produce a filter circuit.

For directly and electrically connecting the resonant conductors B and the respective patterned conductors D of the circuit pattern, the resonant conductors B are typically made to have a length equal to a quarter of the resonance frequency or ¼λ. However, as the resonant conductors B are connected to the patterned conductors D, their inner conductive films are extended at the open-circuit end surface to substantially change the resonating lengths of the conductors B and hence the resonance frequency so that the completed dielectric filter would not perform satisfactorily. If the gap S between the patterned conductors D is modified to regulate the coupling capacitance by either removing the edges of the conductors or adding additional conductor pieces to them, the effective resonating lengths of the resonant conductors B are incidentally modified to consequently change the resonance frequency. Thus, the attempt to obtain a satisfactory dielectric filter would also be thwarted.

It is therefore the object of the present invention to provide a dielectric filter adapted to show a specified coupling capacitance without inadvertently affecting the resonance frequency.

Another object of the present invention is to provide a method of adjusting a coupling capacitance of such a dielectric filter.

SUMMARY OF THE INVENTION

According to a first aspect of the present invention, there is provided a dielectric filter comprising a dielectric block and two or more than two resonant conductors arranged in parallel and including an inner conductive film provided on the inner surfaces of respective through bores of the dielectric block, the outer surfaces of the dielectric block being provided with an outer conductive film except one of the end surfaces carrying the openings of said through bores, making the end surface open, wherein a conductive circuit film for a capacitive coupling is provided on the open-circuit end surface of the dielectric ceramic block and electrically separated from the inner conductive films of the resonant conductors by insulation gaps therebetween to capacitively couple the conductive circuit film and the resonant conductors.

The insulation gaps may be formed around said resonant conductors on the open-circuit end surface of the dielectric ceramic block to capacitively couple the conductive circuit film and the resonant conductors.

Alternatively, the insulation gaps may be formed between the adjacent resonant conductors on the open-circuit end surface of the dielectric ceramic block.

The insulation gaps may be produced by forming the inner conductive films, leaving peripheral areas of the through bores connecting them to the open end face free from the films as insulation gaps, to capacitively couple the conductive circuit film and the adjacent resonant conductors by way of the insulation gaps.

The invention may be applied to a two-stage dielectric filter comprising two resonant conductors or alternatively, a multi-stage dielectric filter having three, four or more resonant conductors.

In a dielectric filter according to the present invention, the inner conductive films are electrically insulated from the conductive circuit film only by means of the insulation gaps. Therefore, the resonating lengths of said resonant conductors are defined by the corresponding lengths of the inner conductive films and not affected by the conductive circuit film. Thus, the coupling capacitance of the filter can be regulated simply by removing the edges of the conductor of the conductive circuit film juxtaposed with the inner conductive films by way of the insulation gaps or cutting the edges of the through bores so as to modify the insulation gaps without changing the length of each inner conductive film.

According to a second aspect of the present invention, there is provided a method of adjusting a coupling capacitance of a dielectric filter comprising a dielectric block and two or more resonant conductors arranged in parallel and including an inner conductive film provided on the inner surfaces of respective through bores of the dielectric block, the outer surfaces of the dielectric block being provided with an outer conductive film except one of the end surfaces carrying the openings of said through bores, making the end surface open, wherein the method comprises the steps of providing a conductive circuit film for a capacitive coupling on the open-circuit end surface of the dielectric ceramic block so that the conductive circuit film is electrically separated from the inner conductive films of the resonant conductors by insulation gaps and at least one edge of the conductive circuit film extends along an associated outer edge of the the open-circuit end surface of the dielectric ceramic block with a distance therebetween, modifying the distance between the edge of the conductive circuit film and the associated outer edge of the the open-circuit end surface of the dielectric ceramic block, thereby adjusting the coupling capacitance in each resonant conductor.

DESCRIPTION OF THE PREFERRED EMBODIMENTS

Now, the present invention will be described by referring to the accompanying drawings that illustrate preferred embodiments of the invention. Note that those components that are mutually the same or similar are denoted by the same reference symbols and will not be described repeatedly.

Figure 1:
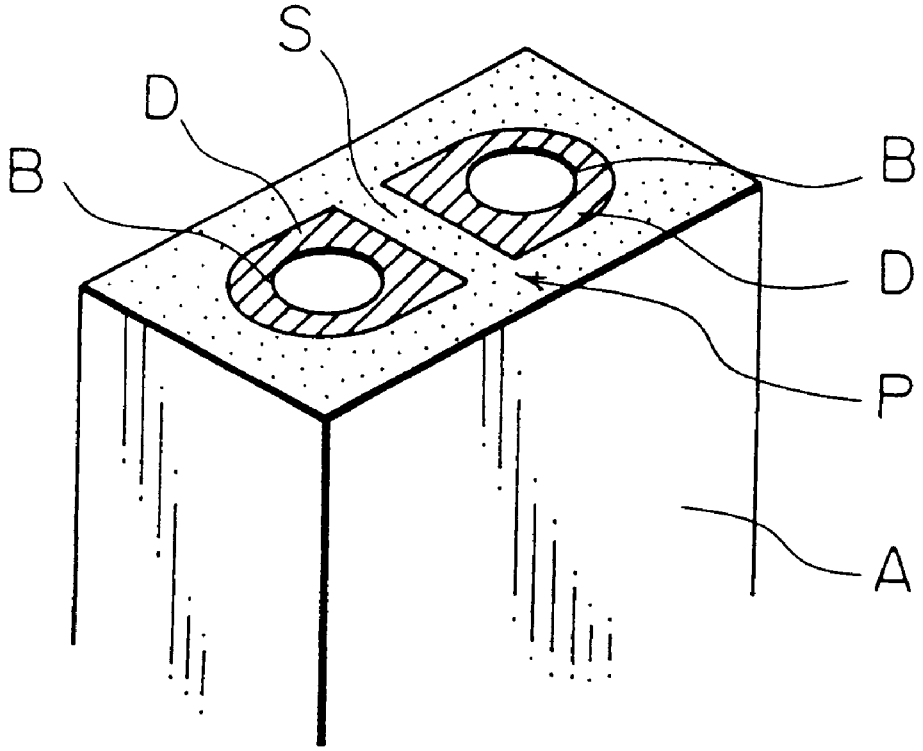
FIG. 1 PRIOR ART
FIG. 1 is a schematic partial perspective view of a conventional dielectric filter.
Figure 2:
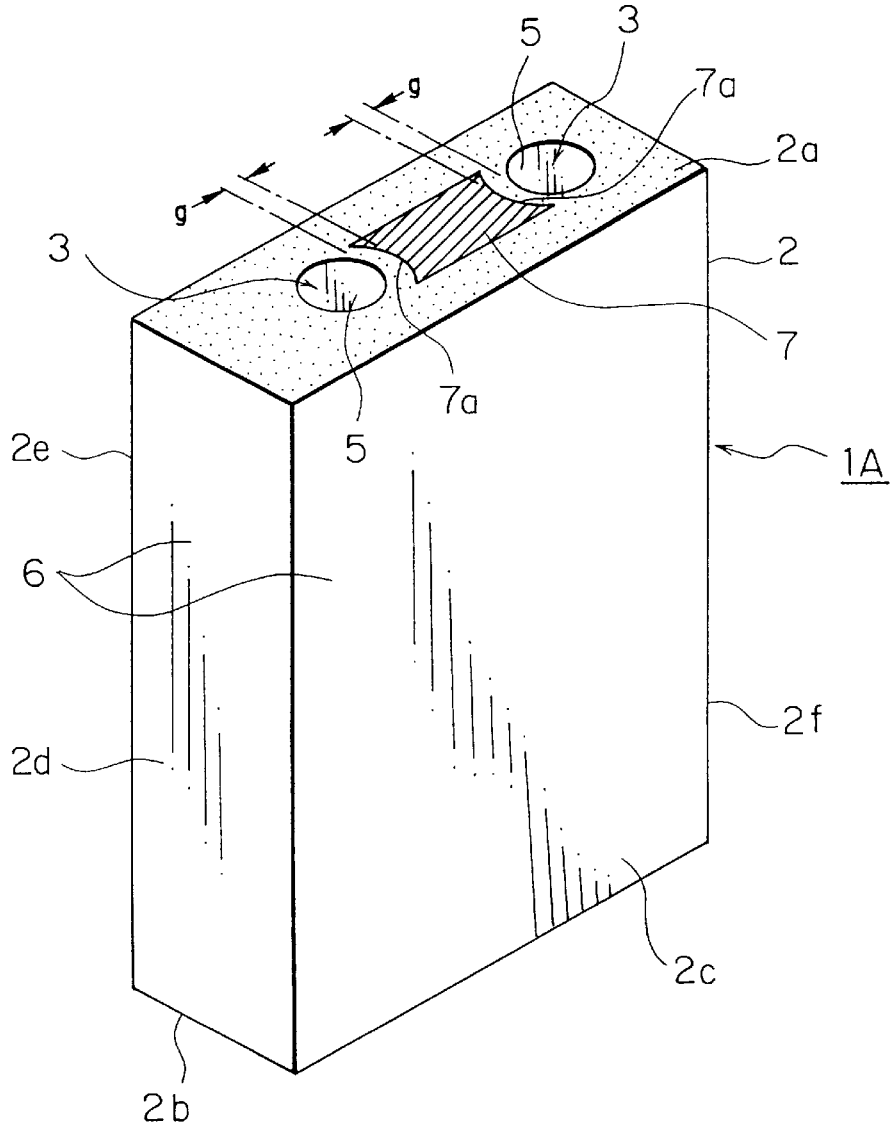
FIG. 2 is a schematic perspective view of a first embodiment of dielectric filter according to the present invention.
Figure 3:
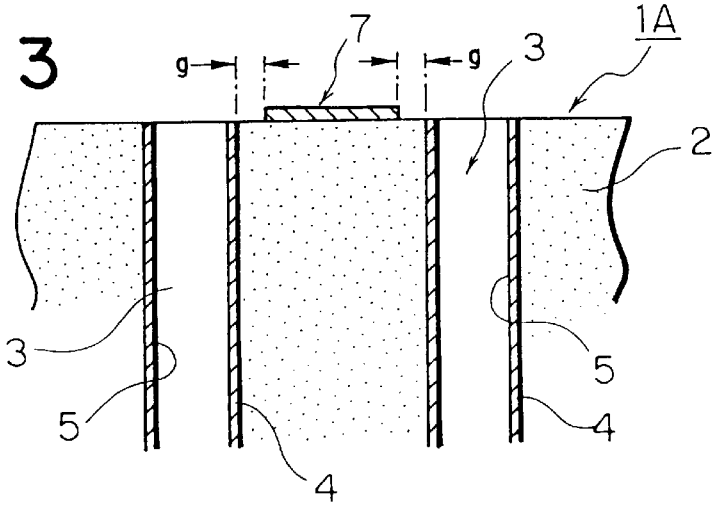
FIG. 3 is a partial longitudinal sectional view of the embodiment of FIG. 2 showing a principal portion thereof.

FIGS. 2 and 3 show a first embodiment of the invention, which is a two-stage type dielectric filter 1A comprising a dielectric ceramic block 2 and a pair of resonant conductors 3. The dielectric ceramic block 2 has a substantially rectangularly parallelepipedic profile and is typically made of a titanium oxide ceramic dielectric material, whereas the resonant conductors 3 are arranged in parallel with each other along the longitudinal direction of the dielectric ceramic block 2. Each of the resonant conductors 3 comprises an inner conductive film 4 (see FIG. 3) provided on a peripheral surface of an associated through bore 5. All the side surfaces 2*b*, 2*c*, 2*d*, 2*e* and 2*f* of the ceramic block 2 except one or front end surface 2*a* of the end surfaces carrying the openings of the through bores 5 are provided with an outer conductive film 6 to provide a shield electrode as shown in FIG. 2. Each of the resonant conductors has a length which corresponds to a resonant length of ¼λ of a resonance frequency.

Now, some principal portions of the illustrated embodiment will be described in detail.

A conductive circuit film 7 for a capacitive coupling is provided on the open-circuit end surface 2*a* of the dielectric ceramic block 2. The conductive circuit film 7 may be formed on the open-circuit end surface by a printing technique, and separated from the peripheral edges of the resonant conductors 3 by respective gaps g. The conductive circuit film 7 has arcuate opposite edges 7*a* (see FIG. 2) disposed vis-a-vis and concentrically relative to the respective peripheral edges of the resonant conductors 3 to define the insulation gaps g so that they show a unique and even width along the respective peripheral edges of the resonant conductors 3.

The conductive circuit film 7 may be formed in a variety of different patterns.

Figure 4:
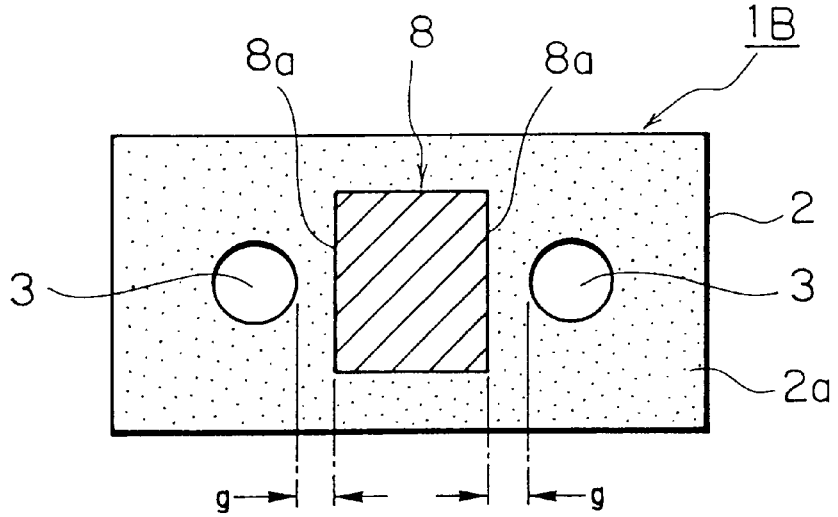
FIG. 4 is a schematic plan view of a second embodiment of dielectric filter according to the present invention.

For example, in FIG. 4 there is shown a dielectric filter 1B in which the the open-circuit end surface 2*a* of the dielectric ceramic block 2 is provided with a conductive circuit film 8 of a square or rectangular pattern having straight opposite edges 8*a* disposed vis-a-vis the respective peripheral edges of the resonant conductors 3.

Figure 5:
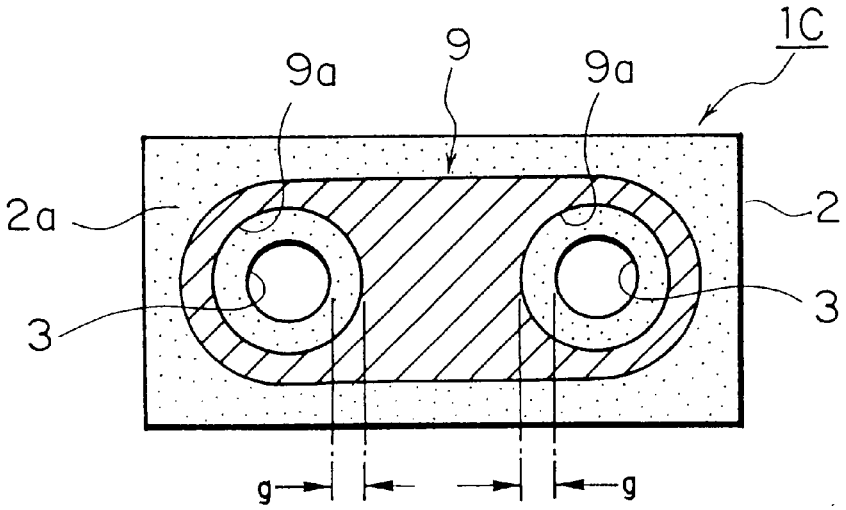
FIG. 5 is a schematic plan view of a third embodiment of dielectric filter according to the present invention.

FIG. 5 illustrates a dielectric filter 1C including an elliptic conductive circuit film 9 having circular openings with the inner edges 9*a* disposed vis-a-vis and concentrically relative to the respective peripheral edges of the resonant conductors 3 to completely surround the resonant conductors 3.

Figure 13:
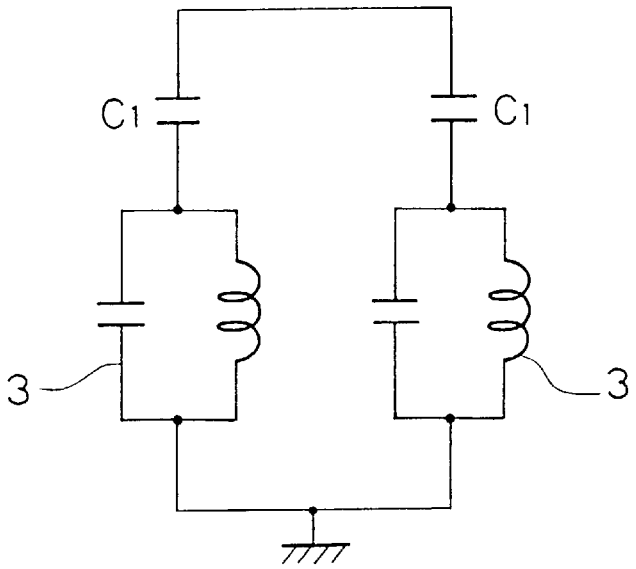
FIG. 13 is a circuit diagram of a filter to which the present invention is directed.

With any of these arrangements, the resonant conductors 3 are electrically disconnected or separated from the conductive circuit film 7, 8 or 9 by the insulation gaps g so that they are capacitively coupled with each other to show an equivalent circuit comprising coupling capacitances C1 as shown in FIG. 13.

Thus, the coupling capacitance of the filter can be regulated simply by removing the edges 7*a*, 8*a* or 9*a* of the conductive circuit films 7, 8 or 9 respectively to modify the width of the insulation gaps g. It will be understood that the resonance frequency of the filter is not changed by such removing because the effective lengths of the resonant conductors 3 remain unchanged.

Figure 6:
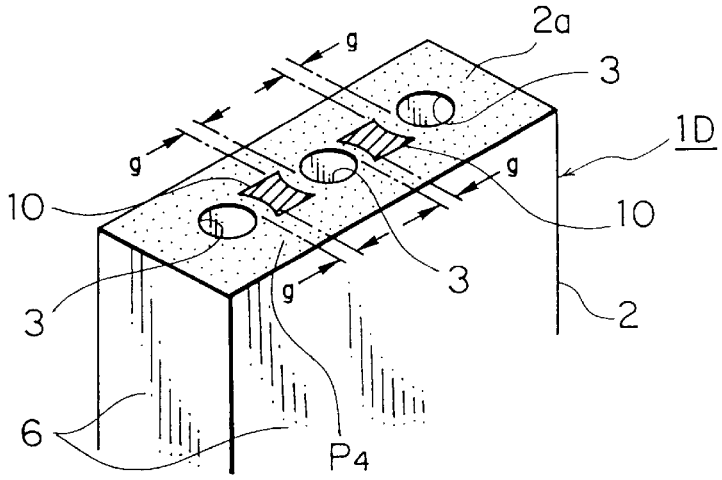
FIG. 6 is a schematic partial perspective view of a fourth embodiment of dielectric filter according to the present invention.

FIG. 6 illustrates a three-stage dielectric filter 1D according to the fourth embodiment of the present invention comprising three resonant conductors 3. In this embodiment, a pair of patterned conductor films 10 are provided to form a conductive circuit film P4. Each conductor film 10 may be formed by a printing technique and disposed on the areas of the open-circuit end surface 2*a* between the adjacent resonant conductors 3 to produce insulation gaps g around the peripheral edges of the resonant conductors 3. Since the role of the insulation gaps g is identical with that of the preceding embodiments, their description will be omitted here.

Figure 7:
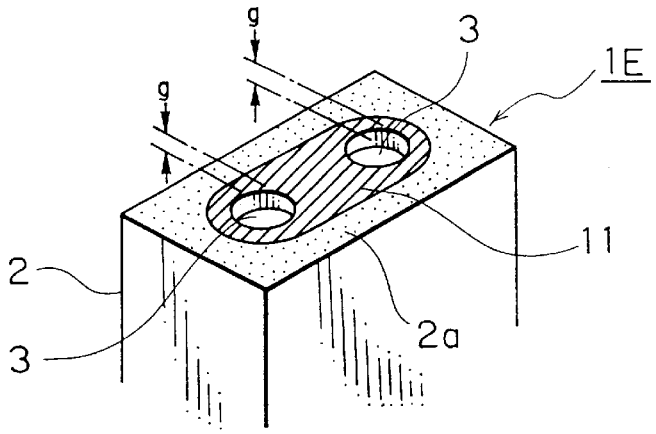
FIG. 7 is a schematic partial perspective view of a fifth embodiment of dielectric filter according to the present invention.
Figure 8:
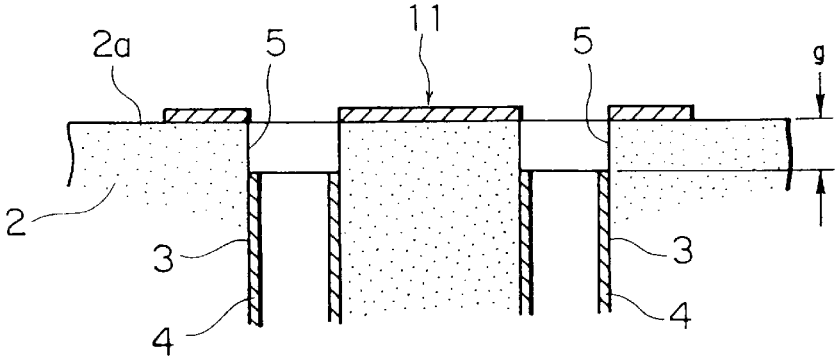
FIG. 8 is an enlarged partial sectional view of the embodiment of FIG. 7 showing an upper portion thereof.

FIGS. 7 and 8 illustrate a two-stage dielectric filter 1E according to the fifth embodiment of the present invention in which the inner conductive films 4 on the through bores 5 are terminated at the regions contiguous to the respective peripheral edges of the through bores 5 on the open-circuit end surface 2*a*. That is, the inner conductive films 4 do not extend to the respective peripheral edges of the through bores 5 on the open-circuit end surface 2*a* so as to form insulation gaps g. As shown in FIG. 8, the insulation gaps g are provided in the inside of the through bores 4. On the other hand, a conductive circuit film 11 in this embodiment is formed on the open-circuit end surface 2*a* by a printing process and arranged to surround the upper edges of the through bores 5 where the resonant conductors 3 are formed. Thus, again, the conductive circuit film 11 is electrically disconnected or separated from the resonant conductors 3 by the insulation gaps g for capacitive coupling so that the equivalent circuit of FIG. 13 also applies to this embodiment.

The conductive circuit film 11 in the dielectric filter 1E has an elliptic outer contour and connects the upper edges of the through bores 5 where the resonant conductors 3 are formed.

Figure 9:
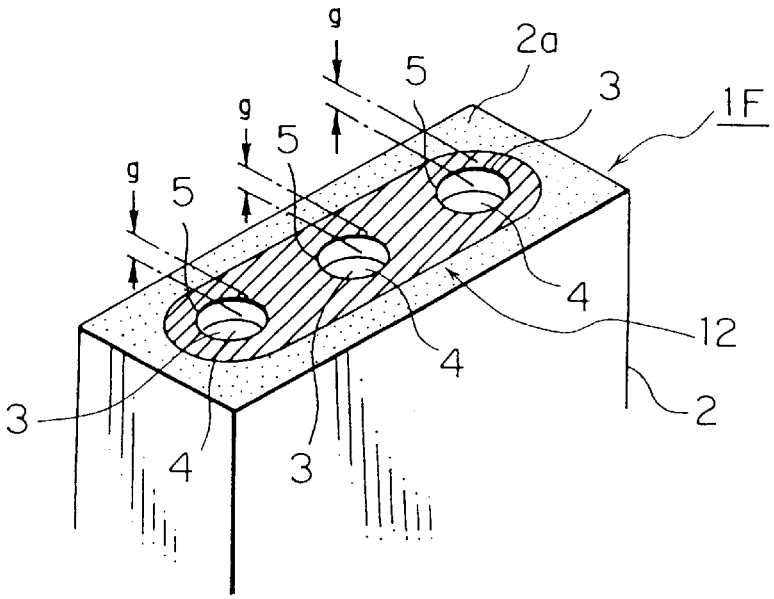
FIG. 9 is a schematic partial perspective view of a sixth embodiment of dielectric filter according to the present invention.

FIG. 9 illustrates another embodiment of the present invention which is a three-stage dielectric filter 1F comprising three resonant conductors 3 in which an elliptic conductive circuit film 12 is arranged on the open-circuit end surface 2*a* of the dielectric ceramic block 2 as in the embodiment shown in FIG. 7. The inner conductive films 4 on the through bores 5 are terminated at the regions contiguous to the respective peripheral edges of the through bores 5 on the open-circuit end surface 2*a*. That is, the inner conductive films 4 do not extend to the respective peripheral edges of the through bores 5 on the open-circuit end surface 2*a* so as to form insulation gaps g. In this way, the insulation gaps g are provided in the inside of the through bores 4. Again, the role of the insulation gaps g is identical with the preceding embodiments and their description will be omitted here.

Figure 10:
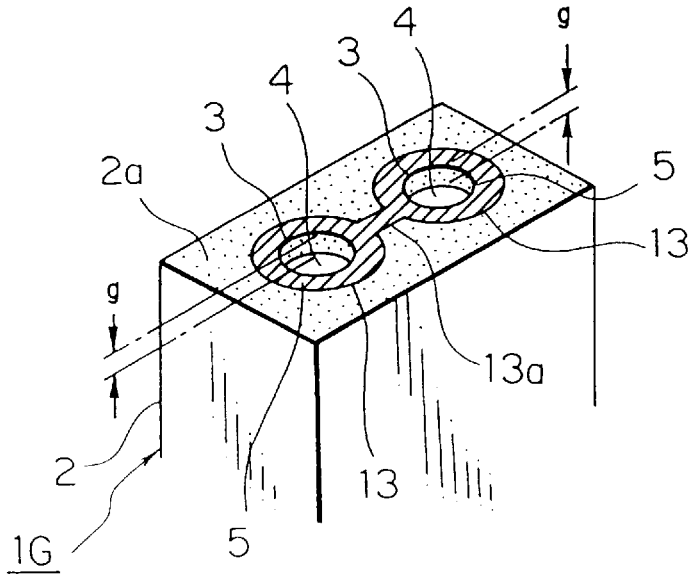
FIG. 10 is a schematic partial perspective view of a seventh embodiment of dielectric filter according to the present invention.

FIG. 10 illustrates a two-stage dielectric filter 1G in which a pair of annular conductive circuit films 13 are arranged concentrically relative to respective resonant conductors 3 and are connected to each other by straight film section 13*a*. With this arrangement, the annular conductive circuit films 13 constitute a pair of annular electrodes having an identical width which are arranged around the respective resonant conductors 3.

Figure 11:
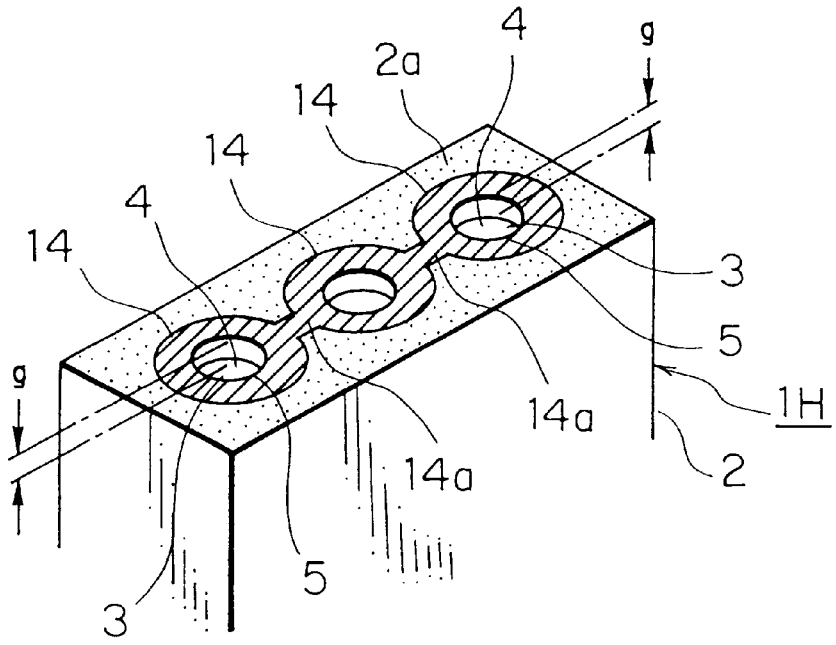
FIG. 11 is a schematic partial perspective view of a eighth embodiment of dielectric filter according to the present invention.

FIG. 11 illustrates a three-stage dielectric filter 1H which comprises three resonant conductors 3 provided in the dielectric ceramic block 2, and three annular conductive circuit films 14 arranged on the open-circuit end surface 2*a* concentrically relative to the respective resonant conductors 3 and connected to each other by straight film sections 14*a*. Since the filter of this embodiment is technically the same as the dielectric filter 1G of FIG. 10 from the viewpoint of the present invention, it will not be described here any further.

Since the insulation gaps g are formed downward from the upper edges of the through bores 5 in the embodiments illustrated in FIGS. 7 to 11, each conductive circuit film may be formed on the open-circuit end surface 2*a* including the upper edges of the through bores 4 where the resonant conductors 3 are formed. Thus, a wide choice may be provided for the profile of the conductive circuit film to be formed.

With any of the conductive circuit films 11 through 14 in the embodiments illustrated in FIGS. 7 through 11, the insulation gaps g are realized by providing no inner conductive film on the areas contiguous to the upper edges of the through bores 5 to make the conductive circuit film electrically disconnected from and capacitively coupled with the resonant conductors 3 so that the equivalent circuit of FIG. 13 having coupling capacitances C1 is applicable to any of the above embodiments. As shown in FIG. 13, the equivalent circuit comprises two parallel branches each comprising a coupling capacitor C1 and a parallel resonant RC circuit 3.

Figure 12:
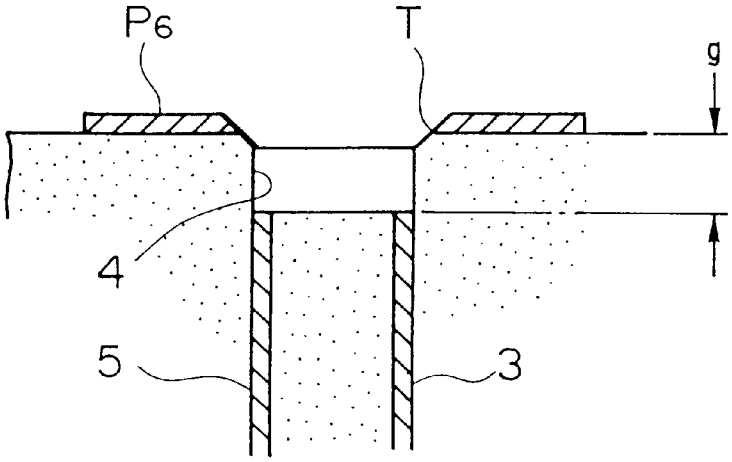
FIG. 12 is an enlarged partial sectional view showing a modification of the embodiment of FIG. 7 in which upper portions of the through bores are chamfered.

The coupling capacitances C1 can be regulated by chamfering the edges of the through bores 5 to produce beveled sections T as shown in FIG. 12. Then, with any of the conductive circuit films 7 through 14, the edge portions of the conductive circuit film(s) surrounding the openings of the through bores 5 may be removed concentrically with the upper edges of the through bores 5 to change the size or width of the insulation gaps g and thus modify the coupling capacitances C1. Note that the inner conductive films 4 are by no means damaged by this operation and the effective lengths of the resonant conductors 3 are unchanged so that the resonance frequency of the dielectric filter remains unaffected.

Figure 14:
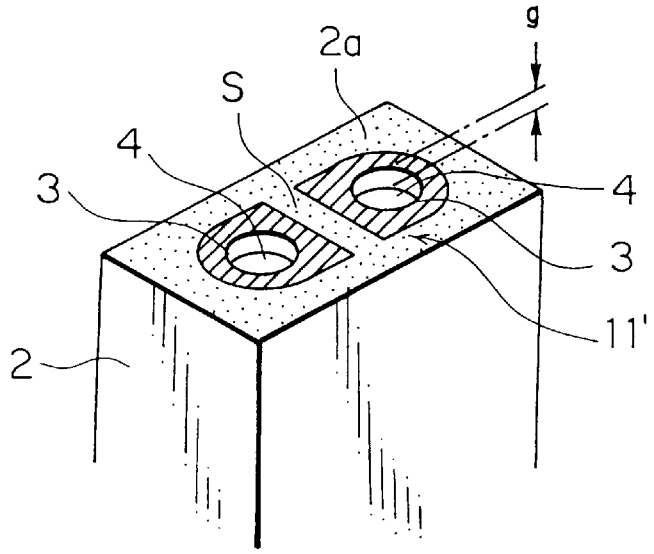
FIG. 14 is a schematic partial perspective view showing a modification of the fifth embodiment of the present invention.

FIG. 14 illustrates a modification of the dielectric filter shown in FIG. 7, in which a conductive circuit film 11' is divided into two sections with a space S therebetween.

Figure 15:
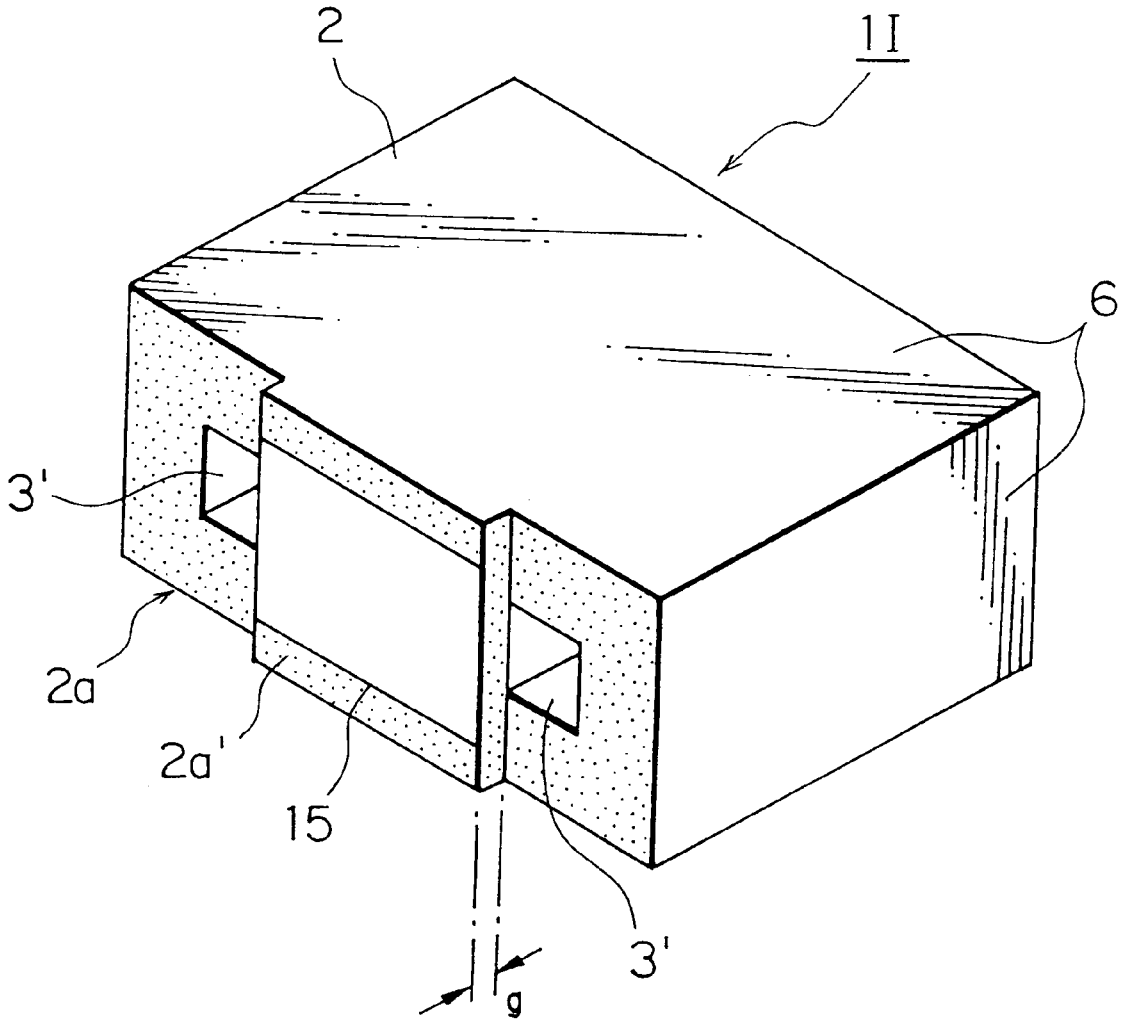
FIG. 15 is a schematic partial perspective view of a ninth embodiment of dielectric filter according to the present invention.
Figure 16:
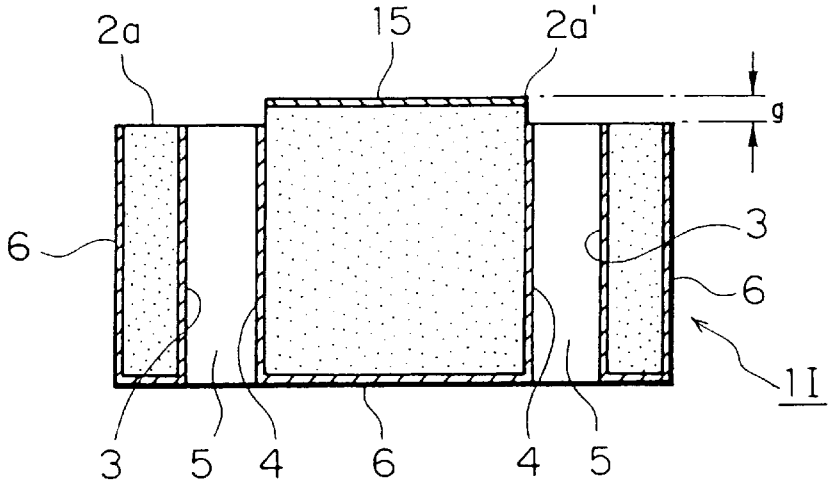
FIG. 16 is a longitudinal sectional view showing the filter according to the embodiment of FIG. 15.

FIGS. 15 and 16 illustrate a dielectric filter 1I in which each of the through bores 5 (see FIG. 16) has a rectanglur shape and the open-circuit end surface 2*a* of the ceramic block 2 has a raised portion 2*a'* spreaded between the resonant conductors 3, where a conductive circuit film 15 is formed so that it extends from one end to the other end of the raised portion 2*a'* along a center line transversing the through bores 5. The forming of the conductive circuit film 15 may be carried out by a printing or coating technique. With this arrangement, the formed conductive circuit film 15 is electrically separated from the resonant conductors 3 by the insulation gaps g which correspond to the height of the raised portion 2*a'*. Thus, any deviation of the position where the conductive circuit film 15 is formed does not affect the insulation gaps g between the conductive circuit film 15 and the respective resonant conductors 3, and therefore the gaps g can be always maintained at constant without any dispersion. The illustrated arrangement has an advantage that a stable coupling capacitances can be obtained. Furthermore, the conductive circuit film can be easily provided without necessity for restrictly defining the shape of the conductive circuit film to be formed because the length of it is defined by the length of raised portion 2*a'*.

Figure 17:
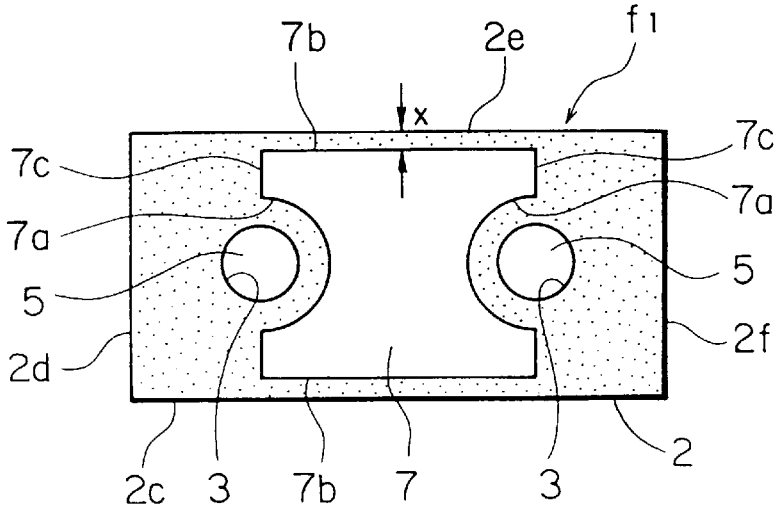
FIG. 17 is a plan view showing a dielectric filter in which a coupling capacitance adjusting method of the present invention is carried out, the filter corresponding to the embodiment of FIG. 2.

FIG. 17 illustrates a dielectic filter prepared in accordance to the embodiment illustrated in FIGS. 2 to 3 as a testing sample. The illustrated filter has a length of 2.9 mm, a width of 5.8 mm, a height of 4.2 mm, an inner diameter of each through bore 5 is 1.0 mm and a distance between the centers of the through bores 5 is 2.9 mm. The inventor has been found that the coupling capacitances may be varied by regulating the distance x from each longitudinal edge 7*b* of the conductive circuit film 7 extended in parallel with a center line transversing the through bores 5 to the edge of the opposite lateral surface 2*e* or 2*c* of the ceramic body 2.

Figure 18A:
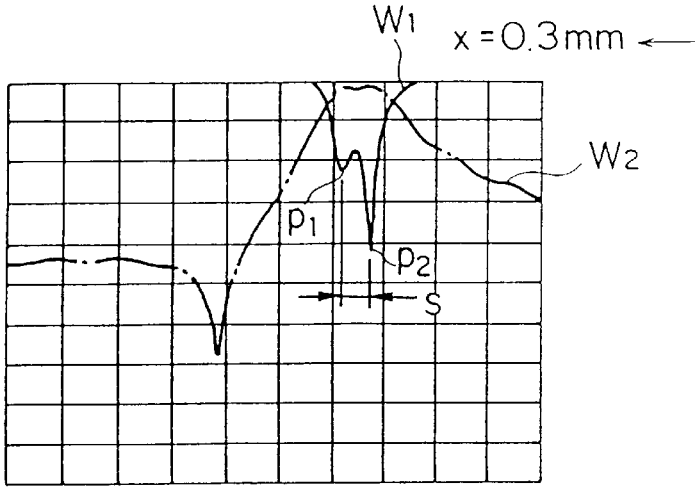
FIGS. 18A, 18B and 18C are three graphs showing the manner in which the frequency characteristic of the dielectric filter is varied for three different values of the distance x as defined below.
Figure 18B:
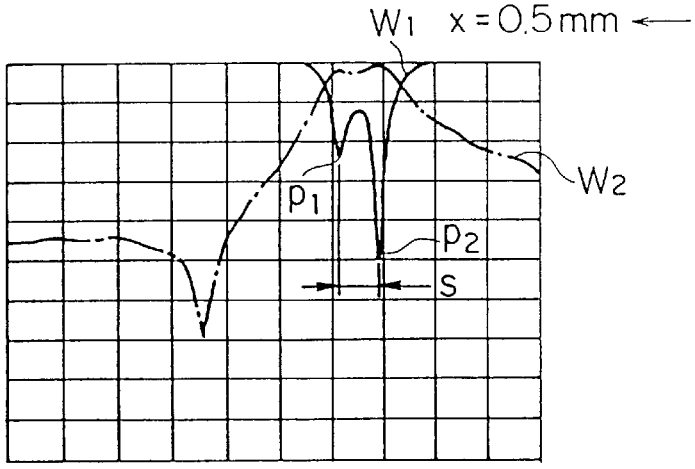
Figure 18C:
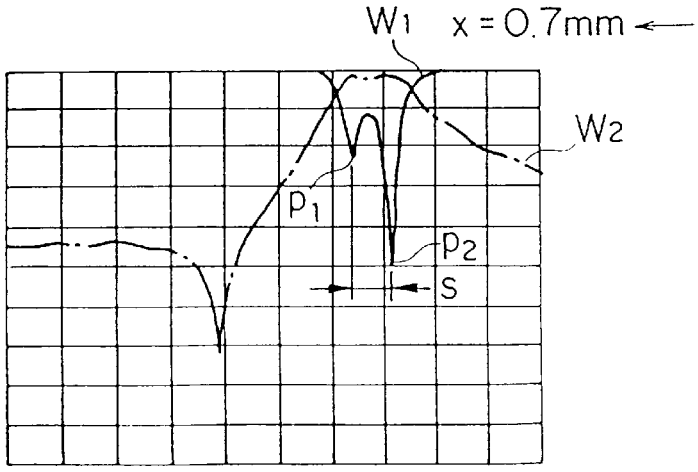

FIGS. 18A, 18B and 18C show frequency characteristics of three samples prepared in accordance to the testing filter illustrated in FIG. 17. In each sample the extensions of the transverse edges 7*c* of the conductive circuit film extended in perpendicular to the the center line intersecting between the through bores are across the centers of the through bores, respectively. With the sample A, x=0.3 mm, with the sample B, x=0.5 mm and with the sample C, x=0.7 mm.

In FIGS. 18A, 18B, and 18C; W1 is a waveform which shows a reflection characteristic and has two peaks p1 and p2 in corresponding to the respective resonant conductors 3. The longer the distance s between the peaks p1 and p2, the larger the coupling capacitance. In regard to the distance s of each of the three samples illustrated, it is appreciated that the longer the distance x, the larger the coupling capacitance. In FIG. 18A, 18B and 18C, W2 is a standard waveform provided for comparison purposes.

It is, therefore, understood that the coupling capacitance for each of the resonant conductors 3 can be regulated based upon the fact that the coupling capacitance may increase as the distance x is increased. If the coupling capacitance in the assembled or completed filter is lower than a desired value, the distance x is increased by removing the edge portions of the conductive circuit film. To the contrary, if the coupling capacitance in the assembled or completed filter is higher than a desired value, the distance x is decreased by adding additional conductors to the longitudinal edge portions 7*b* of the conductive circuit film 7. In this connection, if the distance x would be too increased in the arrangement illustrated in FIG. 17, the transverse edges 7*c* are removed, the length of each of the arcuate edge portions 7*a* becomes shorter than one half of the circumference of the circle, and thus the longitudinal length of the conductive circuit film is shortened. It is, therefore, preferable that the distance x is set so that the arcuate edge portions 7*a* of the conductive circuit film 7 is not substantially shortened. However, if the relation between the coupling capacitance and the length of each arcuate edge portion 7*a* of the conductive circuit film 7 is previously identified, it is possible to regulate the coupling capacitance even if the length of each arcuate edge portion 7*a* of the conductive circuit film 7 is shortened.

Figure 19:
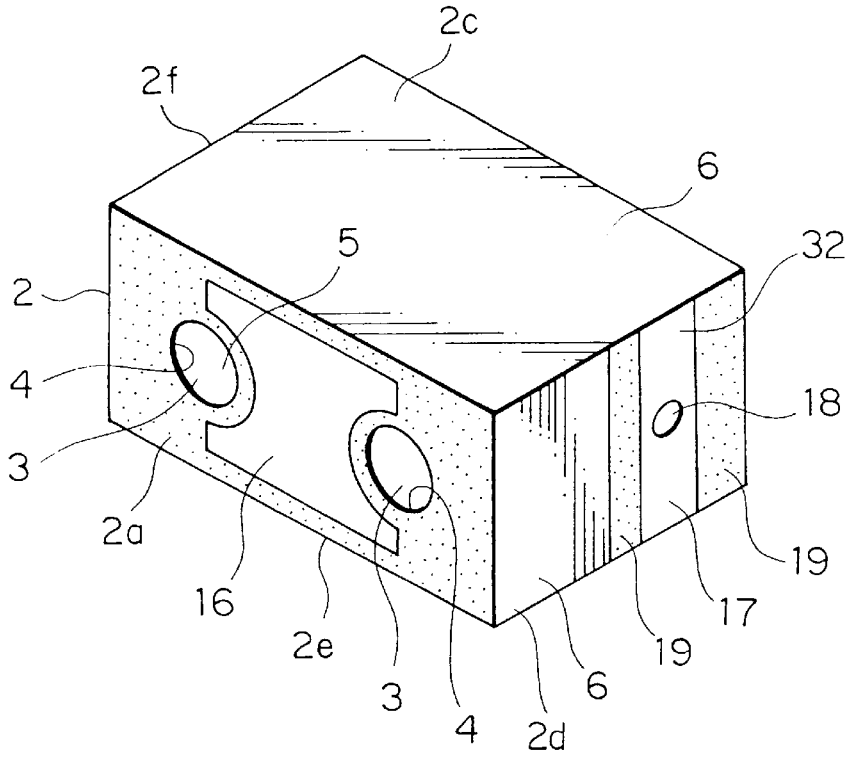
FIG. 19 is a schematic partial perspective view of the dielectric filter of FIG. 17 seen from the front portion thereof, in which an input and output sections are shown.
Figure 20:
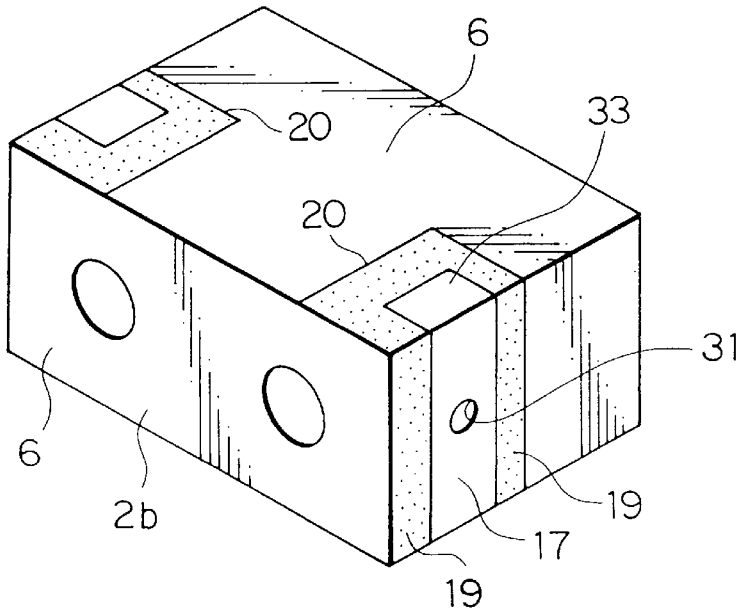
FIG. 20 is a schematic partial perspective view of the dielectric filter of FIG. 17 seen from the rear portion thereof, in which an input and output sections are shown.

FIGS. 19 and 20 illustrate a further embodiment of the present invention in which a filter includes a conductive circuit film 16 (see FIG. 19) having the same pattern as that in FIG. 2 and an input and output pads 17. The other components are arranged in the same manner as that of FIG. 2 and will not be described herein.

The illustrated filter, as shown in FIG. 19, comprises the dielectric ceramic block 2 in which two resonant conductors 3 are provided, each resonant conductor 3 comprises an inner conductive film 4 provided on an associated through bore 5. The dielectric ceramic block 2 is provided with lateral bores 18 (see FIG. 19) each of which is extended from the lateral side surface 2*d* or 2*f* of the dielectric ceramic block 2 to the associated through bore 5 and has an inner surface coated with conductive film. The inner end of the conductive film in each lateral bore 18 is electrically connected to the inner conductive layer 4 in the associated through bore 5, while the outer end of the conductive film is electrically connected to the input and output pads 17. In this way, the resonant conductors 3 are connected to the input and output pads 17. The input and output pads are electrically separated from the outer conductive layer 6 by insulating gaps 19.

Each of the resonant conductors is designed to have a length which corresponds to a resonant length of ¼λ of a resonance frequency. However, the substantial length of each resonant conductor 3 may be varied by the presence of the lateral bores 18. In order to possibly reduce this influence on the length of each resonant conductor 3 it is desirable to position the lateral bores 18 possibly near to the short-circuit end surface 2*b*. However, it is disadvantage to provide the lateral bores possibly near to the short-circuit end surface 2*b* because the ceramic body 2 may be easily chipped off and the machining of such bores is troublesome.

Then, in the arrangement illustrated in FIGS. 19 and 20, each of the input and output pads 17 has one end electrically connected to the outer conductive layer 6 and the other end electrically separated from the outer conductive layer 20 by an insulating gap, thereby providing an inductor to form a L-component. This L-component makes for substantially extending the length of each resonant conductor 3, and thus it is possible to provide the lateral bores 18 relatively apart from the short-circuit end 2*b*. As a result, the providing of the lateral bores 18 can be easily carried out.

While coupling capacitances C1 are produced between the resonant conductors 3 and the conductive circuit film by means of insulation gaps g in any of the above embodiments, the conductive circuit film may also be provided with a gap S to produce another coupling capacitance as shown in FIG. 14, which represents a modification to the fifth embodiment.

As described in detail, according to the present invention, there is provided a dielectric filter comprising a dielectric block and two or more resonant conductors arranged in parallel, wherein a conductive circuit film is formed on the open-circuit end surface of the dielectric ceramic block and electrically disconnected from the inner conductive films of the resonant conductors by arranging insulation gaps therebetween to capacitively couple the conductive circuit film and the resonant conductors by way of the insulation gap. With such an arrangement, the inner conductive films electrically insulated from the conductive circuit film only by means of the insulation gaps. Therefore, the resonating lengths of said resonant conductors are defined only by the corresponding lengths of the inner conductive films and not affected by the conductive circuit film. As a result it is possible to set separately and independently the coupling capacitance and resonant frequency of the filter.

Furthermore, the coupling capacitance of the filter can be regulated without varying the length of each resonant conductor by removing the edges of the conductor of the conductive circuit film juxtaposed with the inner conductive films by way of the insulation gaps, chamfering the edge portions of the through bores, or modifying the distance x between the longitudinal edges of the conductive circuit film and the edges of the ceramic body. In this way, the performance of the dielectric filter can be optically regulated.

We claim:

1. A method of adjusting coupling capacitance in a dielectric filter comprising a dielectric block having outer surfaces including end surfaces, said dielectric block including respective through bores having inner surfaces and defining corresponding openings, at least two resonant conductors arranged in parallel and including inner conductive films provided on respective inner surfaces of corresponding through bores of the dielectric block, the outer surfaces of the dielectric block being provided with an outer conductive film except on one of the surfaces including the openings of said through bores, said one end surface constituting an open-circuit end surface, input/output pads each having one end thereof electrically connected to the outer conductive film and the other end thereof electrically separated from the outer conductive film by a respective insulating gap to thereby provide a corresponding inductor component, and respective lateral bores being provided in the dielectric body and extending between a respective resonant conductor and the corresponding input/output pads, said method comprising the steps of providing a conductive circuit film on the open-circuit end surface of the dielectric block such that the conductive circuit film is electrically separated from the respective inner conductive films of the corresponding resonant conductors by respective further insulation gaps and at least one longitudinal edge of the conductive circuit film extends along an associated outer edge of the open-circuit end surface of the dielectric block with a spacing therebetween, and modifying the spacing between the longitudinal edge of the conductive circuit film and the associated outer edge of the open-circuit end surface of the dielectric block to thereby adjust the coupling capacitance for each resonant conductor.

2. A dielectric filter comprising a dielectric block having outer surfaces including end surfaces, said dielectric block including respective through bores having inner surfaces and defining corresponding openings, and at least two resonant conductors arranged in parallel and including inner conductive films provided on the respective inner surfaces of corresponding through bores of the dielectric block, the outer surfaces of the dielectric block being provided with an outer conductive film except for one of the end surfaces including the openings of said through bores, said one end surface constituting an open-circuit end surface, a conductive circuit film for providing capacitive coupling being provided on the open-circuit end surface of the dielectric ceramic block and being electrically separated from the respective inner conductive films of the corresponding resonant conductors by respective insulation gaps therebetween to capacitively couple the conductive circuit film and the corresponding resonant conductors, said dielectric block including an input pad and an output pad and respective lateral bores having a corresponding inner conductive layer connecting a respective resonator to a corresponding pad, said dielectric block including a short-circuit end surface opposite to said open-circuit end surface and said bores being spaced from said short-circuit end surface of the dielectric block, each of said input and output pads having one end thereof electrically connected to the outer conductive film and having the other end thereof electrically separated from the outer conductive film by a further insulating gap, thereby providing an inductor component.

3. A dielectric filter comprising a dielectric block having outer surfaces including end surfaces, said dielectric block including respective through bores having inner surfaces and defining corresponding openings, and at least two resonant conductors arranged in parallel and including inner conductive films provided on the respective inner surfaces of corresponding through bores of the dielectric block, the outer surfaces of the dielectric block being provided with an outer conductive film except for one of the end surfaces including the openings of said through bores, said one end surface constituting an open-circuit end surface, a conductive circuit film for providing capacitive coupling being provided on the open-circuit end surface of the dielectric ceramic block and being electrically separated from the respective inner conductive films of the corresponding resonant conductors by respective insulation gaps therebetween to capacitively couple the conductive circuit film and the corresponding resonant conductors, said filter comprising a two-stage dielectric filter comprising two resonant conductors, the open-circuit end surface of said dielectric block including a raised portion extending between the resonant conductors, and said conductive circuit film extending from one end of the raised portion to the other end of the raised portion along a center line intersecting the through bores.

* * * * *